US012078424B2

(12) United States Patent
Callbeck

(10) Patent No.: US 12,078,424 B2
(45) Date of Patent: Sep. 3, 2024

(54) APPARATUS FOR HEATING A GAS BURNER UNIT

(71) Applicant: Noralta Technologies Inc., Alberta (CA)

(72) Inventor: Jayden Michael Callbeck, Saskatchewan (CA)

(73) Assignee: Noralta Technologies Inc., Calgary (CA)

( * ) Notice: Subject to any disclaimer, the term of this patent is extended or adjusted under 35 U.S.C. 154(b) by 0 days.

(21) Appl. No.: 17/745,529

(22) Filed: May 16, 2022

(65) Prior Publication Data

US 2023/0366636 A1 Nov. 16, 2023

(51) Int. Cl.
*F28D 20/00* (2006.01)

(52) U.S. Cl.
CPC ..... *F28D 20/00* (2013.01); *F28D 2020/0004* (2013.01); *F28D 2020/0065* (2013.01)

(58) Field of Classification Search
CPC ..... F28D 20/00; F28D 2020/0004; F28D 2020/0065
See application file for complete search history.

(56) References Cited

U.S. PATENT DOCUMENTS

2011/0286724 A1* 11/2011 Goodman ..... F28D 20/0056 165/104.31

* cited by examiner

*Primary Examiner* — Jon T. Schermerhorn, Jr.
(74) *Attorney, Agent, or Firm* — Procopio, Cory, Hargreaves & Savitch LLP

(57) ABSTRACT

The heater block of the present disclosure can transfer heat from a heat transfer fluid to a received fuel fluid, air passing in proximity to the heater block or combinations thereof. These heat transfers reduce, substantially prevent or prevent the freezing of water within the received fuel fluid and/or the air as it enters an intake member of a gas burning unit.

3 Claims, 5 Drawing Sheets

APPARATUS FOR HEATING A GAS BURNER UNIT

TECHNICAL FIELD

This disclosure generally relates to production of oil and/or gas. In particular, the disclosure relates to an apparatus for heating a gas burner unit.

BACKGROUND

Oil and gas producers often use a gas-burning unit (GBU) to burn off gas, such as produced gas, that originates from a subterranean reservoir. The burned off gas can be used as a source of heat for warming tanks that house produced fluids and solids and to heat other features present on a wellsite. Because the reservoir can also contain water, the produced gas itself may contain water and/or water may become entrained in the produced gas. In cold climates, the water that comes to the surface with the produced gas can freeze within the GBU, causing the GBU to malfunction and require maintenance or replacement.

Typically, the problem of having water freeze within the GBU is addressed by placing a heat radiator unit close to an orifice of an intake member of the GBU. As shown in FIG. 2, a GBU 8 has a main burner barrel 10 with an intake member 12. The main burner barrel 10 can receive a gas, such as produced gas, and perform a controlled combustion of the received gas will occur within the barrel 10. The intake member 12 receives air from outside the GBU 8 for mixing with a fuel gas, often times the produced gas, for maintaining control over the combustion of the received gas. A radiator heater 14, such as a pre-air radiator heater, is shown a predetermined distance X from a side of the barrel 10 and the intake member 12. Additionally or alternatively, the radiator heater 14 can be positioned proximal the end of the barrel 10 where the intake member 12 is located, shown as a predetermined distance of X1. Typically, the radiator heater 14 is positioned a predetermined distance of about 6-15 inches (1 inch equals about 2.54 cm) from the outer surface of the barrel 10 and/or the intake member 12. With this known approach, the air that enters the GBU 8 by the intake member 12 is warmed in an effort to prevent freezing of the produced-gas water content. However, if the ambient temperature drops substantially below the freezing point of water the heat radiator 14 may not provide sufficient heat that can travel the predetermined distance to heat the GBU 8. As such water present in the intake member 12 or elsewhere in the GBU 8 can freeze.

Additionally, the GBU 8 may also include a glycol heating system (not shown) and often times a heat radiator 14 can impart flow restrictions in the glycol flow lines, which in turn can strain fittings and connectors of the glycol heating system.

SUMMARY

The embodiments of the present disclosure relate to a heater block for transferring heat from a heat transfer fluid to an intake of a gas burner unit. The heater block comprises a body and the body defines: an input port for receiving a heat transfer fluid and an output port for egress of the heat transfer fluid. The body also defines a first internal fluid conduit that extends between the first port and the second port through the heater block. The body also defines a fuel inlet port for receiving a fuel fluid; a fuel outlet port for egress of the fuel fluid; and, a second internal fluid conduit that extends between the fuel inlet port and the fuel outlet port. Due to the design of the heater block, the first internal fluid conduit and the second internal fluid conduit are fluidly separated so that there is no mixing of the heat transfer fluid and the received fuel fluid.

Without being bound by any particular theory, the heater block of the present disclosure can transfer heat from the heat transfer fluid to the received fuel fluid, air passing in proximity to the heater block or combinations thereof. These heat transfers can reduce, substantially prevent or prevent the freezing of water within the received fuel fluid and/or the air as it enters an intake member of a gas burning unit.

BRIEF DESCRIPTION OF THE DRAWINGS

These and other features of the present disclosure will become more apparent in the following detailed description in which reference is made to the appended drawings.

FIG. 4 shows two sides of two embodiments of a heater block according to the embodiments of the present disclosure, wherein

DETAILED DESCRIPTION

Figure 1:
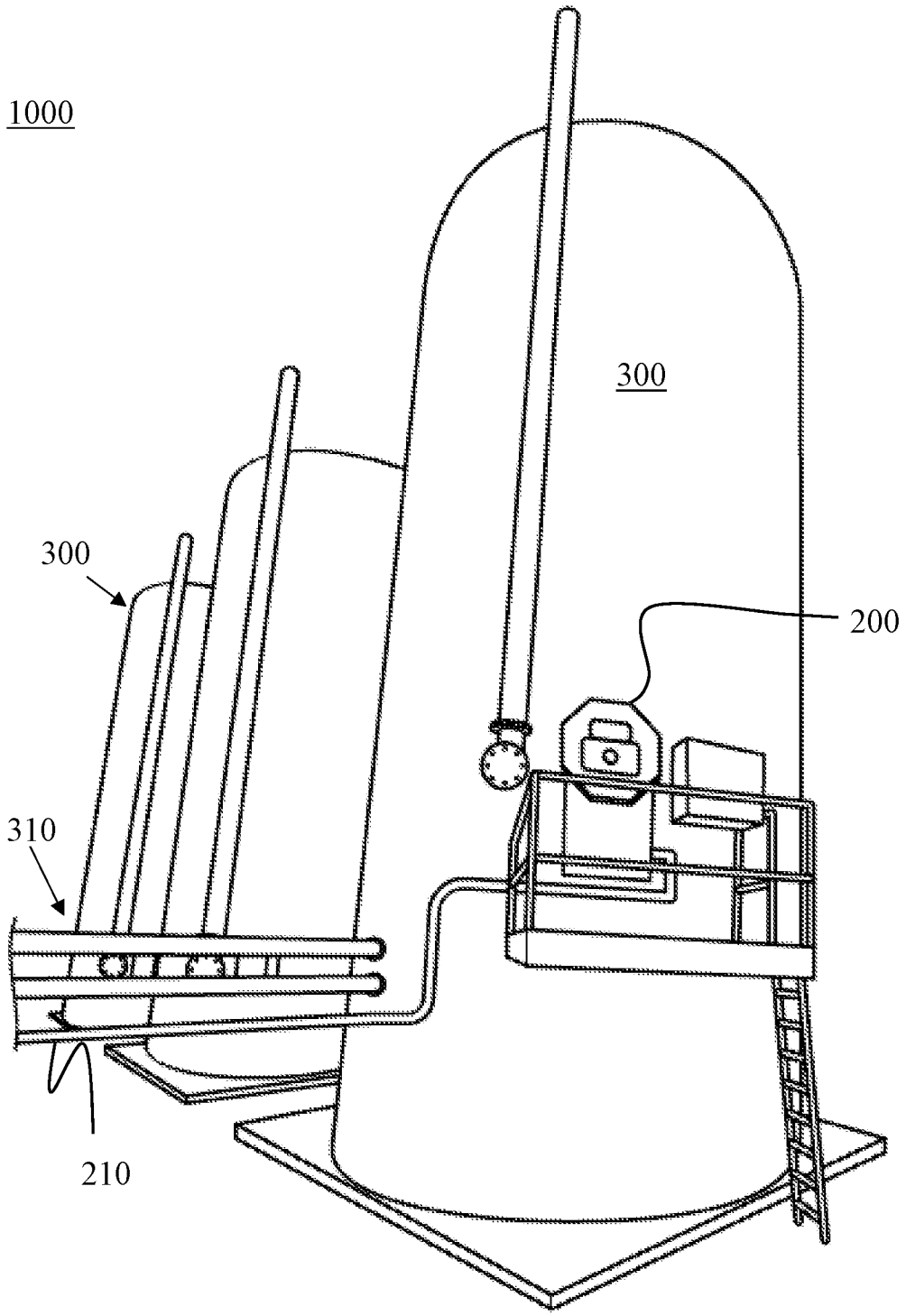
FIG. 1 shows a well site with a produced fluid tank system.
Figure 2:
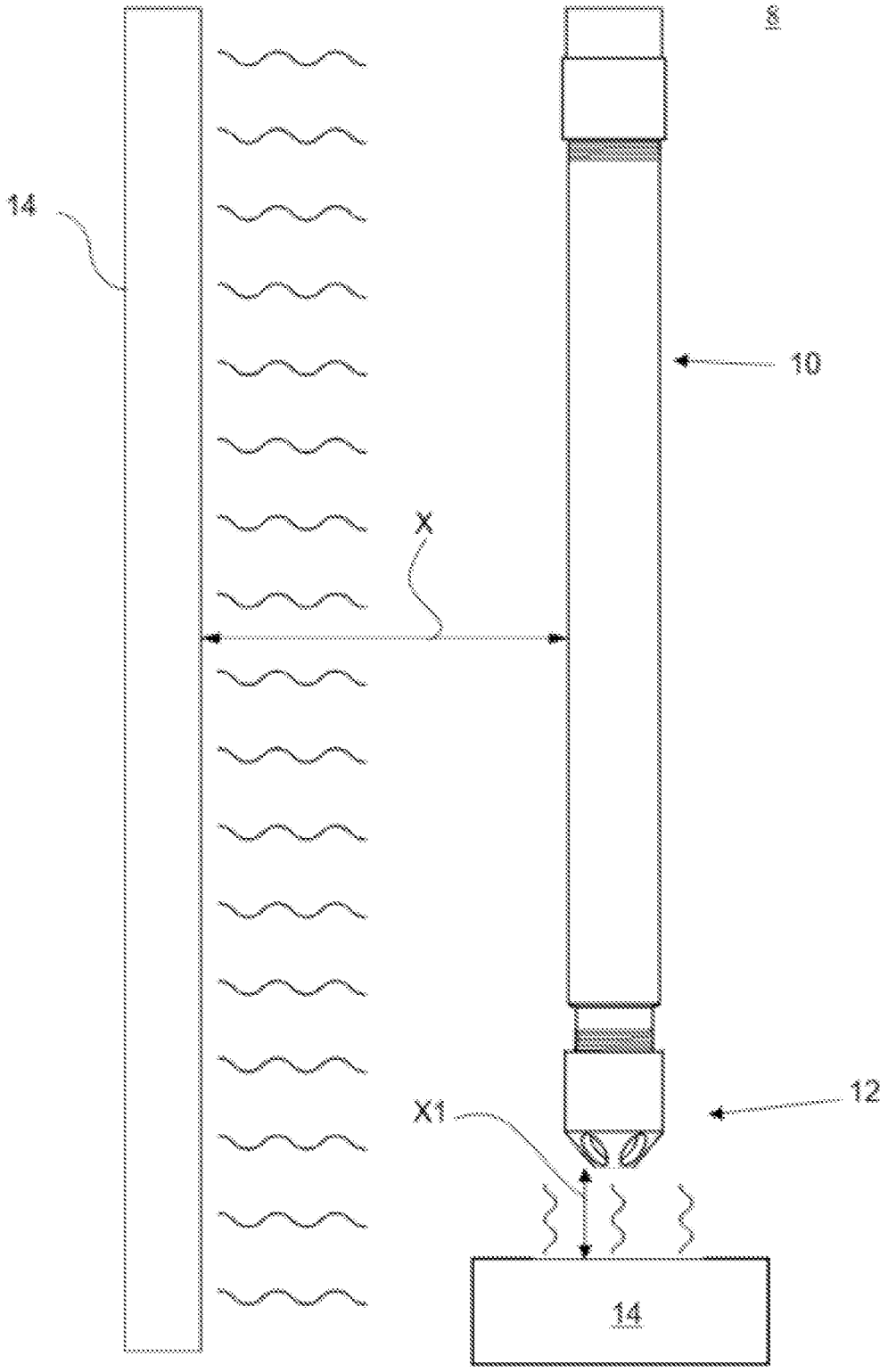
PRIOR ART FIG. 2
FIG. 2 shows as schematic of a known radiator heater arrangement for warming intake air, fuel fluids or both of a produced gas burner.

FIG. 1 shows a wellsite 1000 with one or more produced fluid tanks 300. Each tank 300 can receive produced fluids from a wellhead (not shown) via one or more produced-fluid conduits 310. According to the embodiments of the present disclosure, the wellsite 1000 can include a housing 200 for housing one or more components of a gas-burning unit (GBU), where the housing 200 is positioned on or proximal a sidewall of a tank 300. As discussed further below, a burner barrel of the GBU can extend into a portion of a sidewall of the tank 300 and contain a controlled combustion process therein for heating the contents of the tank 300.

The embodiments of the present disclosure relate to an apparatus and system for heating an intake member of a GBU 100. The GBU 100 comprises a main burner barrel 102, an intake member 104 and a heater block 106. The GBU 100 can receive fuel gas and perform a controlled combustion of the received fuel gas to generate heat. The main burner barrel 102 can be of various designs and dimensions, depending on the type and amount of gas it will receive and burn through the controlled combustion process. The main burner barrel 102 can be positioned within a portion of a produced-fluid tank 300, where such portion may be an inward extension of the sidewall, to transfer heat to a mixture of produced fluids housed within the tank 300. The received fuel gas may be produced gas from a subterranean oil and/or gas reservoir. Due to the presence of water in the reservoir, the received gas also includes water.

The intake member 104 draws gas, such as air, from outside the GBU 100 into the barrel 102 and fuel gas from a fuel source, wherein the fuel source can be a source of produced gas such as a wellhead or another fluid conduit. As will be appreciated by those skilled in the art, the air may also contain water that can freeze inside the intake member 104 when ambient temperatures are cold enough. The intake member 104 has a first end 104A and a second end 104B and it defines an internal fluid conduit therebetween (not shown). The first end 104A has a first connector 105A that is connectible to the heater block 106 according to the embodiments of the present disclosure. The second end 104B has a second connector 105B that is connectible to the barrel 102. As will be appreciated by those skilled in the art, the first connector 105A and the second connector 105B can be any type of industry approved and safety rated connector for connecting fluid conduits that convey flammable fluids. For example, the first connector 105A and the second connector 105B may be threaded connectors or connectors that are welded together. The first connector 105A and the second connector 105B may have the same outer diameters, or different outer diameters. Proximal the first end 104A, the intake member 104 defines one or more intake apertures 107 for drawing air into the internal conduit. In some embodiments of the present disclosure, the intake member 104 can be made of a thermally conductive material, such as a metal or metal alloy including but not limited to: copper, aluminum, brass, steel, bronze, stainless steel and steel. In some embodiments of the present disclosure, the intake member 104 is made of a material with a greater potential to conduct thermal energy as compared to the materials that the barrel 102 is made of.

The heater block 106 transfers heat to a received fuel fluid, the intake member 104, air entering the intake member 104 or both to reduce, substantially prevent or prevent freezing of any of the water content of the received gas, any air entering the intake member 104 or combinations thereof. The heater block 106 is made of a thermally conductive material. For example, the heater block 106 may be made of a metal or an alloy. In some embodiments of the present disclosure, the heater block 106 is made of a material with a greater potential to conduct thermal energy as compared to the materials that the barrel 102 is made of. In some embodiments of the present disclosure, the heater block 106 can be made of a thermally conductive material, such as a metal or metal alloy including but not limited to: copper, aluminum, brass, steel, bronze, stainless steel and steel.

Figure 3:
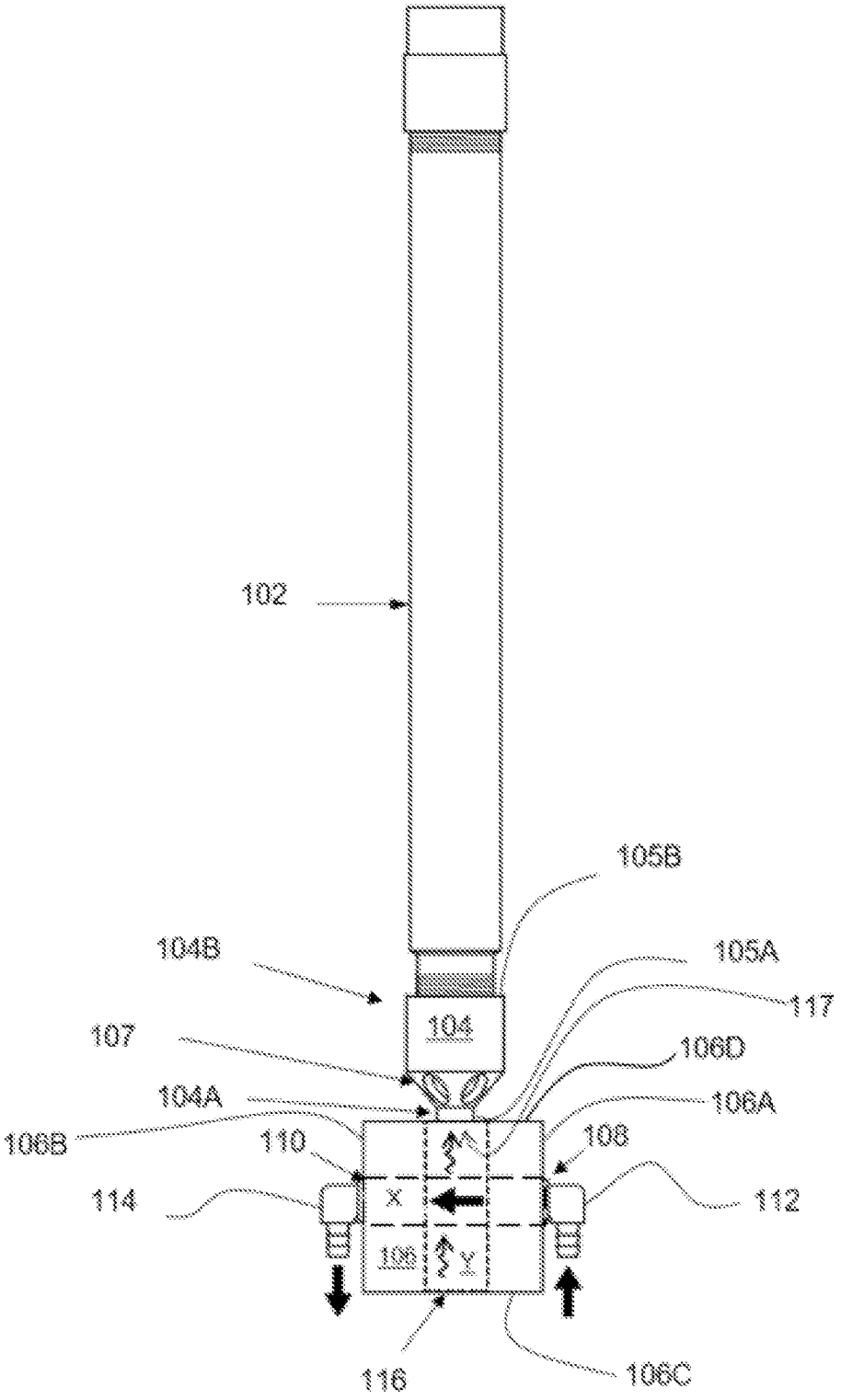
FIG. 3 shows a top plan view of a heater system according to embodiments of the present disclosure, with internal fluid conduits shown in dashed lines and fluid flow directions shown with arrows.
Figure 4A:
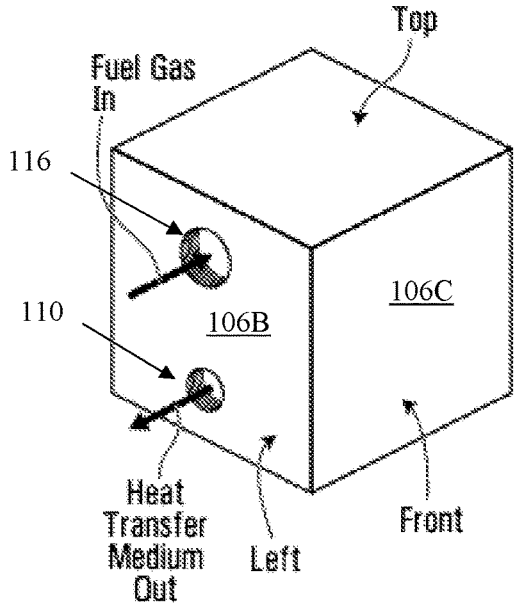
FIG. 4A is an isometric view that shows a front side and a left side of a heater block.
Figure 4B:
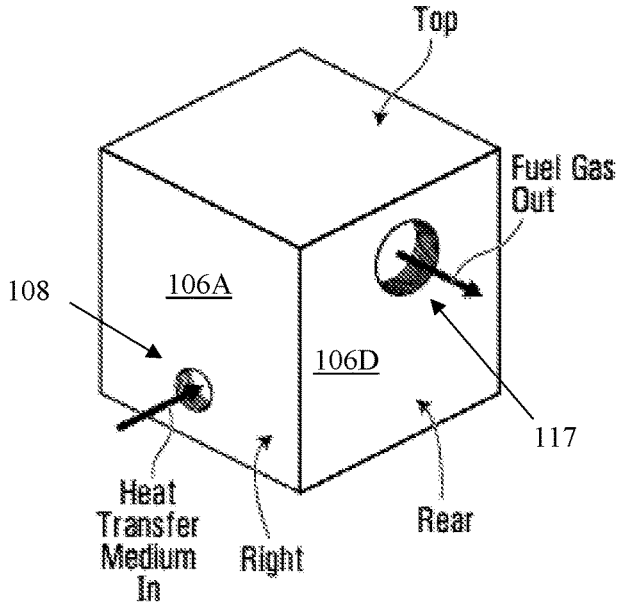
FIG. 4B is an isometric view that shows a back side and a right side of the heater block of FIG. 4A.
Figure 4C:
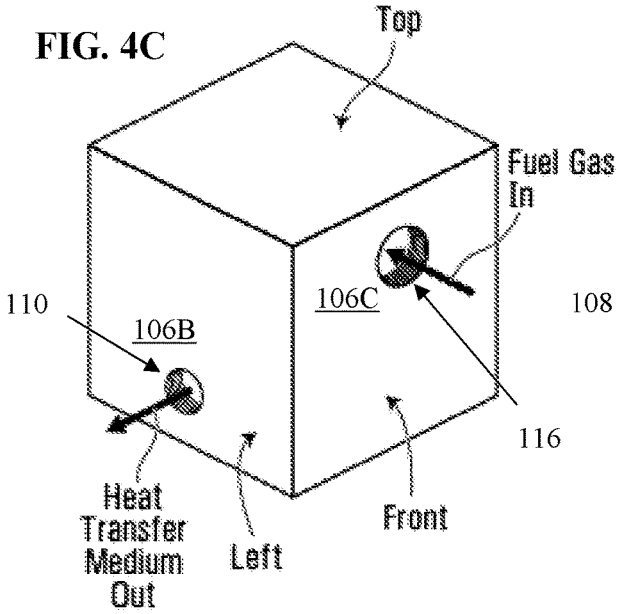
FIG. 4C is an isometric view that shows a front side and a left side of another embodiment of a heater block; and, FIG. 4D is an isometric view that shows a back side and a right side of the heater block of FIG. 4C.
Figure 4D:
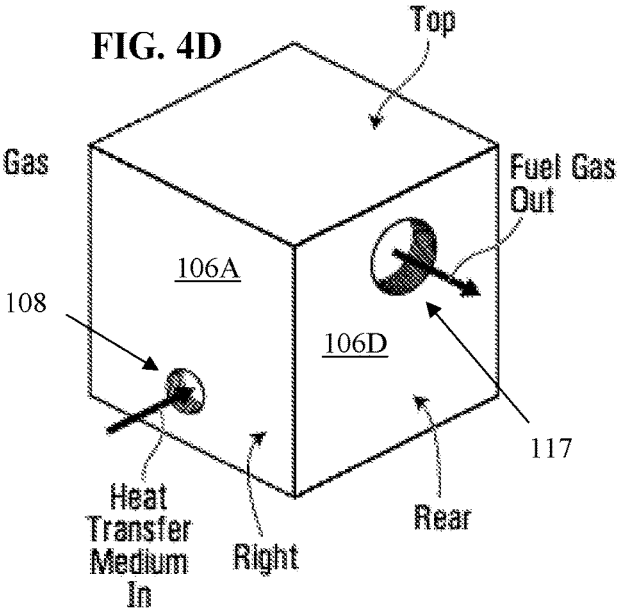

The heater block 106 defines a first internal conduit X and a second internal conduit Y, each for conveying a fluid through different flow paths within the heater block 106. In some embodiments of the present disclosure, the first internal conduit X (shown in FIG. 3 by the larger the dashed lines with the flow direction indicated by the larger solid arrows) can convey a heat transfer fluid through the heater block 106 between a first side 106A and a second opposite side 106B. In some embodiments of the present disclosure, the second internal conduit Y (shown in FIG. 3 by the smaller dashed lines with the flow direction indicated by the squiggled arrows) can convey a fluid fuel through the heater block 106 between a third side 106C and a fourth side 106D that is opposite to the third side 106C and the fourth side 106D is connectible to the intake member 104. In some embodiments of the present disclosure, the second internal conduit Y can convey a fluid fuel through the heater block 106 from the first side 106A or the second side 106B to the fourth side 106D that is opposite to the third side 106C (as shown in FIG. 4A and FIG. 4B). The first internal conduit X and the second internal conduit Y are fluidly separated, meaning there is no fluid communication therebetween so that within the heater block 106 any fluid within the first internal conduit X does not mix with any fluid in the second internal conduit Y and vice versa. In some embodiments of the present disclosure, the first internal conduit X is substantially straight, without any curves or bends. In some embodiments of the present disclosure, the second internal conduit Y is substantially straight (as shown in FIG. 3 and FIG. 4B and FIG. 4D), or it may have define a turn, for example, when the second internal conduit Y extends from the first or second side 106A, 106B to the fourth side 106D (as shown in FIG. 4A and FIG. 4B).

In some embodiments of the present disclosure, the heater block 106 defines an input port 108 (shown defined on the first side 106A) and an output port 110 (shown defined on the second side 106B) and the first internal conduit X extends therebetween. The input port 108 is connectible to a fitting 112 and the port 110 is connectible to a fitting 114. The internal conduit X extends between the input port 108 and the output port 110 for providing fluid communication therebetween and between fitting 112 and fitting 114. The heater block 106 can receive a heat transfer fluid via the input port 108 and egress the heat transfer fluid via the output port 110 while passing through the first internal conduit X of the heater block 106. In some embodiments of the present disclosure, the fittings 112, 114 are made of a thermally conductive material.

The heater block 106 also defines a fuel inlet port 116 (shown defined on the third face 106C) and a fuel outlet port 117 (shown defined on the fourth face 106D).

Figure 5:
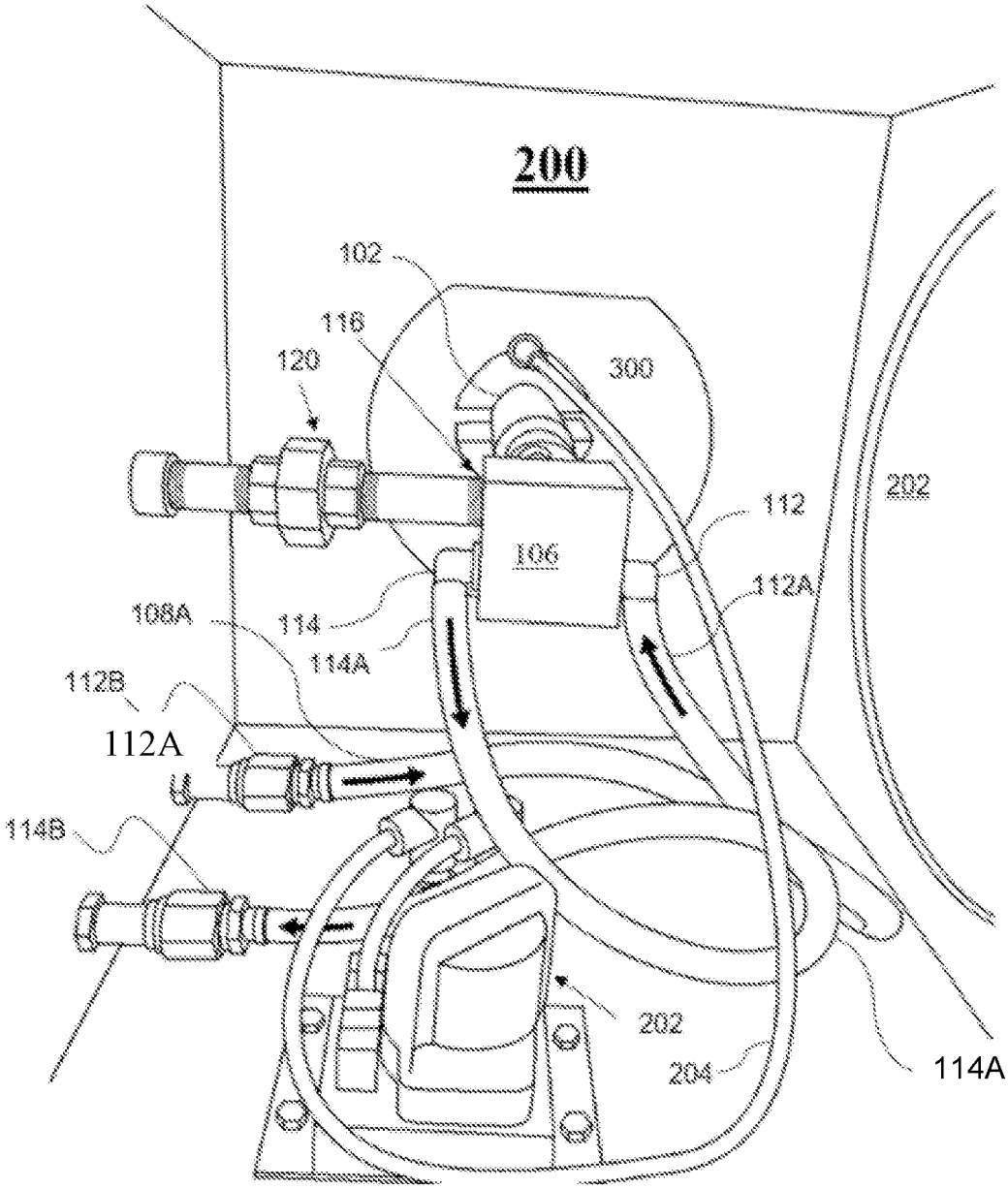
FIG. 5 shows portions of a system according to embodiments of the present disclosure.

FIG. 5 shows a non-limiting example of the heating block 106 as part of the GBU 100 installed within the housing 200 that is secured on an exterior wall of a produced fluid tank 300. The housing 200 may have four sidewalls and a top and bottom wall. Optionally, one sidewall may include a flame arrestor 202. Another sidewall may define one or more ports for receiving fittings to permit fluid communication of the fuel fluid (via conduit 120, which may be one or more lengths of suitable conduit for conveying a flammable fuel fluid) and the heat transfer fluid (via fitting 112B and conduit 112A and conduit 114A and fitting 114B) from outside the housing 200 to inside the housing 200 and vice versa. The housing 200 may house an electrical spark and/or flame control system 202 that includes an ignition control line 204 that can contribute towards the controlled combustion process that can occur inside the barrel 102. Another sidewall of the housing 200 may define an aperture through which the barrel 102 extends out of the housing 200 for heating the contents of the produced fluid tank 300.

The heat transfer fluid may ingress into the housing 200 via conduit 210, fitting 112B and then be conveyed to fitting 112 via the conduit 112A. The heat transfer fluid may then pass through the first internal conduit X of the heating block 106, transfers from the heat transfer fluid to heat the heater block 106. The heat transfer fluid may then egress from the first internal conduit X and travel between fitting 114 and 114B, via the conduit 114A, for egress from the housing 200. The flow rates and volume of the heat transfer fluid within the conduits 112A and 114A and, therefore, within the first internal conduit X of the heating block 106 may be controlled by a pump and controller system, as known in the art, outside the housing 200 (not shown). In some embodiments of the present disclosure, the heat transfer fluid can be a liquid, a gas or a mixture thereof. In some embodiments of the present disclosure, the heat transfer fluid may be oil-based or water-based. In some embodiments of the present disclosure, the heat transfer fluid may be a substantially pure fluid or it may be a mixture of constituent fluids. In some embodiments of the present disclosure, the heat transfer fluid has a freezing point that is sufficiently low so that it can be used in climates with temperatures that can reach below 0° C. or below −5° C. or below −10° C. or below −15° C. or colder. In some embodiments of the present disclosure, the heat transfer fluid may be glycol or a mixture of glycol and water. For example, further conduits may be fluidly connected to the pump and controller system for providing heat conducting fluid to warm one or more of the production conduits 310. In some embodiments of the present disclosure, the heat transfer fluid may be heated to a temperature of between about 50° C. and 110° C. so that when the heat transfer fluid enters the heating block 106 the thermally conductive material of the heating block 106 will facilitate a transfer of heat from the heat transfer fluid through the heating block 106 and at least a portion of that transferred heat will transfer into the received fuel fluid.

Without being bound by any particular theory, the heating block 106 may transfer heat from the heat transfer fluid to the received fuel fluid by conduction. The heating block 106 may transfer heat from the heat transfer fluid to the received fuel fluid by convection. The heating block 106 may transfer heat from the heat transfer fluid to air that is passing by the heating block 106 before it enters the intake member 104. Additionally, the heating block 106 may transfer heat from the heat transfer fluid to the intake member 104 by conduction, convection or a combination thereof. Heating of the received fuel fluid that is conducted through the heating block 106, heating of the air that is passing in proximity to the heating block 106, heating of the intake member 104 or combinations thereof may reduce, substantially prevent or prevent freezing of water within the received fuel fluid and/or the air passing in proximity to the heating block 106.

The invention claimed is:

1. A heater block for transferring heat from a heat transfer fluid to an intake member of a gas burner unit, the heater block comprising:

(a) a body that defines:

(i) an input port for receiving a heat transfer fluid;

(ii) an output port for egress of the heat transfer fluid, (iii) a first internal fluid conduit that extends between the input port and the output port through the heater block;

(iv) a fuel inlet port for receiving a fuel fluid;

(v) a fuel outlet port for egress of the fuel fluid, wherein the fuel outlet port is connectible to the intake member of the gas burner unit by a connector that is configured to convey the fuel fluid, wherein the fuel fluid is flammable; and (vi) a second internal fluid conduit that extends between the fuel inlet port and the fuel outlet port, the first internal fluid conduit and the second internal fluid conduit are fluidly separated and wherein the body is made of a thermally conductive material for transferring heat from the heat transfer fluid to the intake member.

2. The heater block of claim 1, wherein the input port and the output port are defined on opposing faces of the body.

3. The heater block of claim 1, wherein the fuel inlet port and the fuel outlet port are defined on opposing faces of the body.

* * * * *